US011828040B2

(12) United States Patent
Brabec

(10) Patent No.: US 11,828,040 B2
(45) Date of Patent: Nov. 28, 2023

(54) METHOD AND APPARATUS FOR MITIGATING MACHINE OPERATOR COMMAND DELAY

(71) Applicant: Topcon Positioning Systems, Inc., Livermore, CA (US)

(72) Inventor: Vernon Joseph Brabec, Livermore, CA (US)

(73) Assignee: Topcon Positioning Systems, Inc., Livermore, CA (US)

( * ) Notice: Subject to any disclaimer, the term of this patent is extended or adjusted under 35 U.S.C. 154(b) by 351 days.

(21) Appl. No.: 16/585,662

(22) Filed: Sep. 27, 2019

(65) Prior Publication Data

US 2021/0095437 A1 Apr. 1, 2021

(51) Int. Cl.

| | |
|---|---|
| ***F15B 9/09*** | (2006.01) |
| ***E02F 3/65*** | (2006.01) |
| ***E02F 3/38*** | (2006.01) |
| ***E02F 3/43*** | (2006.01) |
| ***E02F 3/84*** | (2006.01) |
| ***E02F 9/20*** | (2006.01) |
| ***E02F 9/26*** | (2006.01) |

(52) U.S. Cl.

CPC ..... *E02F 3/651* (2013.01); *E02F 3/382* (2013.01); *E02F 3/437* (2013.01); *E02F 3/845* (2013.01); *E02F 9/2033* (2013.01); *E02F 9/265* (2013.01)

(58) Field of Classification Search

CPC . E02F 3/651; E02F 3/382; E02F 3/437; E02F 3/845; E02F 9/2033; E02F 9/265; E02F 9/2228; E02F 9/2285; E02F 3/435–439; F16H 61/437; F15B 13/043; F15B 2211/328; F15B 9/09

See application file for complete search history.

(56) References Cited

U.S. PATENT DOCUMENTS 2,668,062 A * 2/1954 Drummond ..... A01B 63/22 280/43.23
3,169,650 A * 2/1965 Soyland ..... E02F 9/003 280/402

(Continued)

FOREIGN PATENT DOCUMENTS

DE 112016000015 T5 12/2016
DE 102017223143 A1 6/2019

(Continued)

OTHER PUBLICATIONS

International Search Report and Written Opinion mailed in connection with International Patent Application No. PCT/US2020/047683, filed Sep. 27, 2019, 11 pgs.

(Continued)

*Primary Examiner* — Edwin J Toledo-Duran

(74) *Attorney, Agent, or Firm* — CHIESA SHAHINIAN & GIANTOMASI PC

(57) ABSTRACT

A method for machine grade assist includes determining whether user input will cause an implement of a machine to dig below a desired grade. User input to move a stick of an excavator can be blocked and/or delayed using hydraulic pressure so that movement of both the stick and the boom of the excavator can be synchronized to prevent a bucket of the excavator from digging below a desired grade when the stick is moved.

20 Claims, 8 Drawing Sheets

(56) References Cited

U.S. PATENT DOCUMENTS 3,252,605 A * 5/1966 Orwig ..... E02F 3/342 414/702
3,289,546 A * 12/1966 Erickson ..... E02F 3/434 92/132
3,400,634 A * 9/1968 Wirtz ..... E02F 3/432 92/132
3,407,946 A * 10/1968 Pilch ..... E02F 3/384 91/410
3,616,940 A * 11/1971 Milner, Jr. ..... B66C 23/545 212/300
3,713,557 A * 1/1973 Seaberg ..... E02F 3/433 414/700
4,593,586 A 6/1986 Cudnohufsky
5,524,437 A 6/1996 Larkin et al.
5,701,795 A 12/1997 Friedrichsen
6,047,228 A * 4/2000 Stone ..... E02F 9/2025 701/50
6,285,913 B1 9/2001 Haegglund
7,318,292 B2 * 1/2008 Helbling ..... E02F 9/2214 91/393
7,878,481 B2 2/2011 Kallfass et al.
7,975,410 B2 * 7/2011 Faivre ..... G05D 1/0891 37/379
9,322,149 B2 * 4/2016 Takaura ..... E02F 3/43
9,404,237 B2 * 8/2016 Faivre ..... E02F 9/265
9,410,305 B2 * 8/2016 Matsuyama ..... E02F 9/2033
9,469,969 B2 * 10/2016 Kanari ..... E02F 9/262
9,540,793 B2 * 1/2017 Kami ..... G01C 15/00
9,677,251 B2 * 6/2017 Kitajima ..... E02F 3/3677
9,725,874 B2 * 8/2017 Meguriya ..... E02F 9/265
9,803,340 B2 10/2017 Shimano et al.
10,443,214 B2 10/2019 Shimano et al.
10,975,896 B2 4/2021 Bohm et al.
2003/0097837 A1 * 5/2003 Hiraki ..... F15B 21/08 60/486
2006/0062662 A1 * 3/2006 Curl ..... E02F 3/388 414/680
2006/0104785 A1 * 5/2006 Vachon ..... E02F 3/384 414/686
2008/0162004 A1 * 7/2008 Price ..... G05D 1/0251 701/50
2008/0203372 A1 * 8/2008 Ellefson ..... E02F 9/24 254/93 VA
2009/0107016 A1 * 4/2009 Hill ..... E02F 3/3631 37/446
2009/0234508 A1 9/2009 Kallfass et al.
2009/0290940 A1 * 11/2009 Martin, Sr. ..... E02D 3/123 172/136
2012/0245782 A1 * 9/2012 Kawasaki ..... E02F 9/2292 903/930
2012/0251285 A1 * 10/2012 Oyama ..... E02F 9/0875 414/722
2013/0042935 A1 * 2/2013 Post ..... F15B 13/043 137/561 R
2013/0333364 A1 * 12/2013 Carpenter ..... E02F 9/2203 60/420
2015/0308081 A1 * 10/2015 Takaura ..... E02F 3/437 701/50
2016/0160472 A1 * 6/2016 Voda ..... E02F 3/435 73/488
2016/0186406 A1 * 6/2016 Nakagaki ..... E02F 3/435 414/685
2016/0251835 A1 9/2016 Kitajima et al.
2016/0251836 A1 * 9/2016 Baba ..... E02F 9/265 701/50
2016/0281323 A1 9/2016 Imaizumi
2017/0121930 A1 * 5/2017 Kitajima ..... E02F 9/2296
2017/0284057 A1 * 10/2017 Moriki ..... E02F 9/2041
2017/0314234 A1 * 11/2017 Paull ..... E02F 3/32
2018/0002899 A1 * 1/2018 Morimoto ..... E02F 3/43
2018/0112685 A1 4/2018 Beschorner et al.
2018/0230671 A1 * 8/2018 Wu ..... E02F 9/265
2018/0305898 A1 10/2018 Kobayashi et al.
2019/0063041 A1 * 2/2019 Izumi ..... F02D 29/02
2019/0078290 A1 * 3/2019 Yamada ..... E02F 9/262
2019/0169818 A1 * 6/2019 Narikawa ..... E02F 3/437
2019/0226181 A1 * 7/2019 Imura ..... E02F 9/2221
2020/0157768 A1 * 5/2020 Ito ..... E02F 9/2203

FOREIGN PATENT DOCUMENTS

JP H11-190305 A 7/1999
JP 2000-018209 A 1/2000
JP 2003-194013 A 7/2003
JP 2006265954 A 10/2006
WO 2003021365 A2 3/2003
WO 2012067975 A2 5/2012

OTHER PUBLICATIONS

Non-Final Office Action dated Dec. 30, 2019, in connection with Utility U.S. Appl. No. 16/113,060, filed Aug. 27, 2018, 19 pgs.
Shimano et al., "Development of PC210LCi-10/PC200i-10 Machine Control Hydraulic Excavator," Komatsu Technical Report, 2014, vol. 60, No. 167, pp. 1-7.
Extended European Search Report dated Jan. 4, 2019, in connection with European Application No. 18190882.3; 8 pgs.
International Search Report and Written Opinion dated Nov. 27, 2020, in connection with International Patent Application No. PCT/US2020/047544, filed Sep. 27, 2019, 10 pgs.
Final Office Action dated Jun. 25, 2020, in connection with U.S. Appl. No. 16/113,060, filed Aug. 27, 2018, 11 pgs.
Non-Final Rejection dated Dec. 7, 2021. in connection with U.S. Appl. No. 16/585,784, filed Sep. 27, 2019, 9 pgs.
Non-Final Office Action dated Jan. 19, 2022, in connection with U.S. Appl. No. 16/113,060, filed Aug. 27, 2018, 18 pgs.
Final Office Action dated May 25, 2022, in connection with U.S. Appl. No. 16/113,060, filed Aug. 27, 2018.
Non-Final Office Action dated Oct. 5, 2022, in connection with U.S. Appl. No. 16/113,060, filed Aug. 27, 2018, 30 pgs.
Non-Final Office Action dated Sep. 13, 2023 in connection with U.S. Appl. No. 16/113,060, filed Aug. 27, 2018, 32 pgs.

* cited by examiner

METHOD AND APPARATUS FOR MITIGATING MACHINE OPERATOR COMMAND DELAY

BACKGROUND

The present disclosure relates generally to construction machines and, more particularly, to a mode of operation of a construction machine to assist a user in modifying a surface while preventing digging below a desired grade by delaying and synchronizing movement of a boom and stick of an implement of an excavator.

Construction machines, such as excavators, are often used to modify a surface based on a desired site plan. The site plan typically includes a specification for a desired grade. Material located above the desired grade must be removed. Removal of the material located above the desired grade without digging below the desired grade can be challenging. Users of construction machines often dig below a desired grade due to inexperience or by accident. Experienced users can also unintentionally dig below a desired grade due to unsynchronized movement of parts of an implement of a construction machine. For example, users often unintentionally dig below a desired grade due to actuation of a stick of an excavating implement prior to actuation of a boom of the excavating implement. Actuation of the stick with a delay in actuation of the boom because of delays in the hydraulic system of the construction machine can cause the bucket located on the end of the stick to dig below a desired grade before the boom can be moved upward to prevent such digging.

SUMMARY

A method and apparatus for machine operator command delay senses a signal commanding a stick of an excavator to move and delays the movement of the stick so that both the stick and boom of the excavator can be moved simultaneously, under control of a processor and appropriate algorithms, during an operation in which a target surface trajectory is also defined. Delay of the actuation of the stick and synchronization of the movement of the stick with the computed movement of the boom of an excavator occur when the excavator is placed in a grade assist mode.

The method includes the step of detecting when a user has placed the machine in a grade assist mode. When in grade assist mode, a signal in response to user input to move a stick of the construction machine toward (or away) the body of the construction machine is detected. Movement of the stick is hydraulically delayed. A desired movement of the boom of the construction machine in response to the signal is determined based on predicted movement of the stick and the desired design surface trajectory. The desired movement of the boom is to maintain a bucket of the construction machine above a desired grade. A desired movement of the stick of the construction machine is determined in response to the user signal and is based on the predicted movement of the stick and the desired movement of the boom. The desired movement of the stick is to maintain the bucket of the construction machine above the desired grade. The boom and the stick are then hydraulically actuated based on the determined desired movements. In one embodiment, the determination of the desired movements is further based on a current position of the bucket of the construction machine with respect to the desired grade design. The current position of the boom, stick, and bucket can be determined based on data from sensors. In one embodiment, determining a desired movement of the boom is based on a swing arc of the stick and a swing arc of the boom.

DETAILED DESCRIPTION

Figure 1:
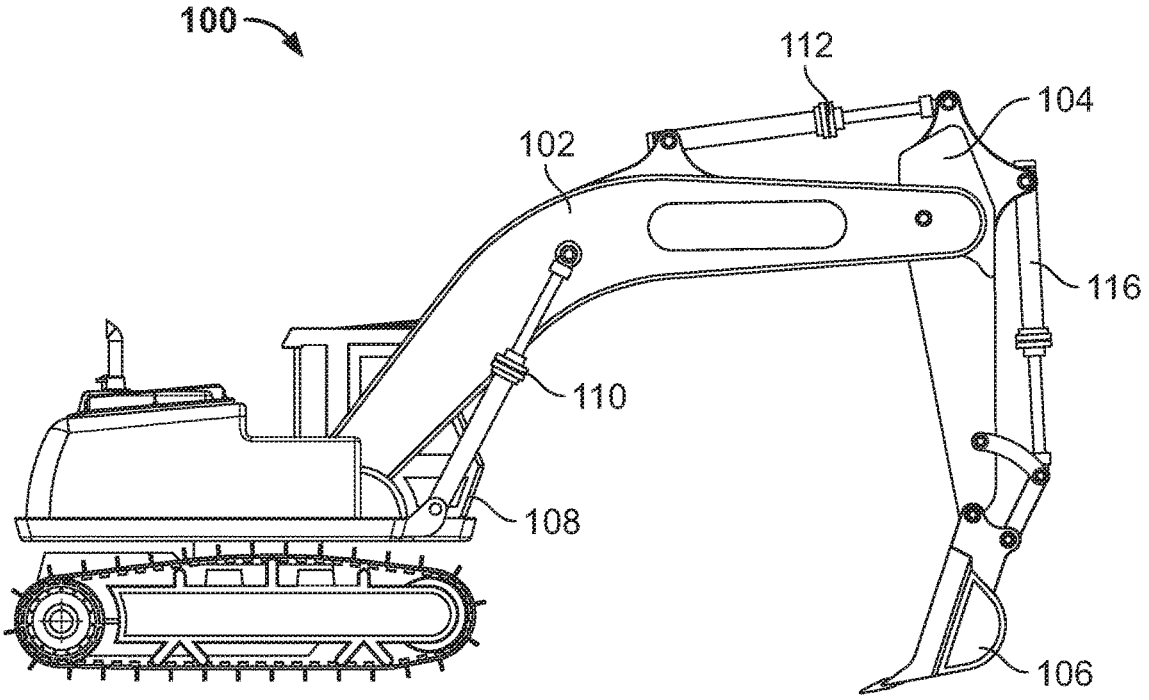
FIG. 1 shows an excavator for modifying a construction site.

FIG. 1 shows a construction machine, specifically excavator 100. Excavator 100 has an implement (e.g., a surface modifying implement) comprising boom 102, stick 104, and bucket 106 which are each controlled by a user located in cab 108 of excavator 100. Cab 108 is part of what is referred to as the body of excavator 100 which can include treads or other means of conveyance. In one embodiment, the user actuates a joystick located in cab 108 to move boom 102 via hydraulic fluid pressure applied to hydraulic cylinder 110. The user actuates another joystick to move stick 104 via hydraulic fluid pressure applied to hydraulic cylinder 112. The user actuates an additional joystick to move bucket 106 via hydraulic fluid pressure applied to hydraulic cylinder 116. A user modifies a surface using the implement in accordance with a desired design surface trajectory (e.g., a desired design surface shape).

Figure 2:
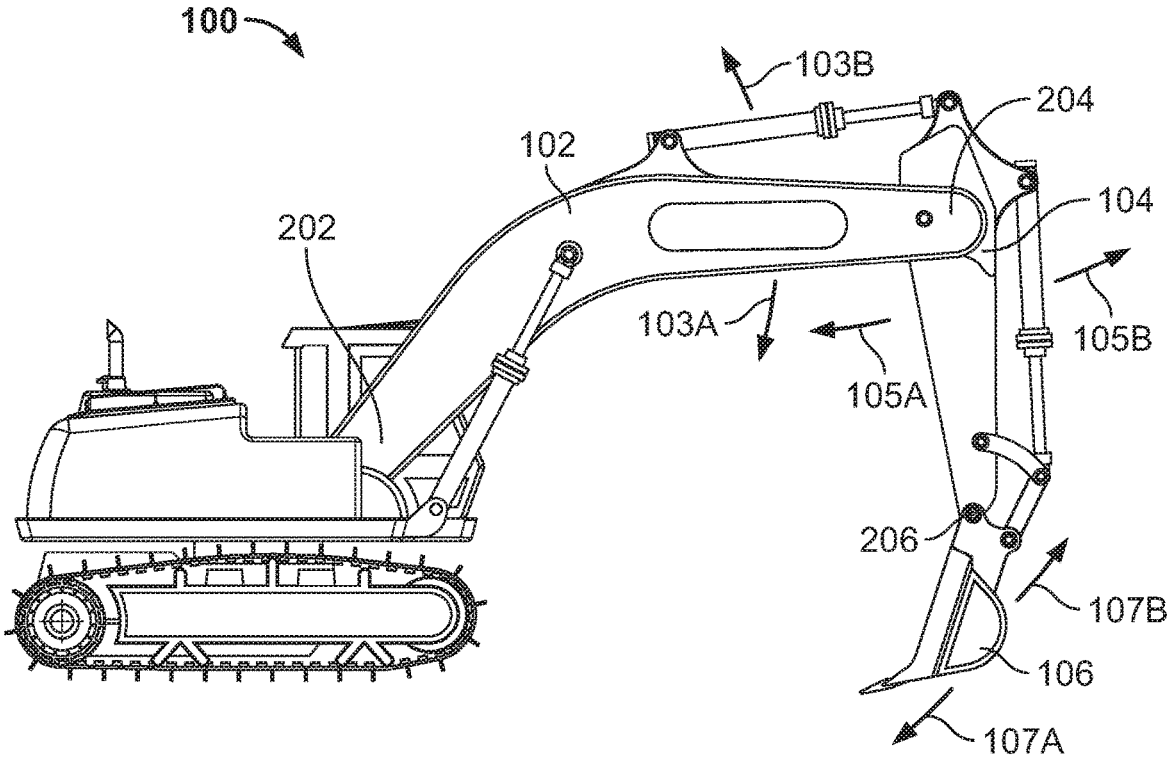
FIG. 2 shows possible movements of an implement of an excavator.

FIG. 2 shows the possible directions of movement of each part of the implement of excavator 100. As shown in FIG. 2, boom 102 can move about pivot 202 as shown by arrows 103A and 103B. As such, boom 102 moves generally toward or away from a surface on which excavator 100 is located. Stick 104 can be moved about pivot 204 as shown by arrows 105A and 105B. As such, stick 104 moves substantially toward or substantially away from the body of excavator 100. Bucket 106 moves about pivot 206 as shown by arrows 107A and 107B. As such, bucket 106 moves substantially toward or substantially away from the main body of excavator 100.

In normal operation, an operator located in cab 108 actuates one of multiple joysticks to move each of boom 102, stick 104, and bucket 106. Actuation of each joystick causes hydraulic fluid pressure to be applied to a respective hydraulic cylinder to move one of the boom 102, stick, 104 and bucket 106. Although the movement of a respective joystick causes hydraulic fluid pressure to be applied to a respective hydraulic cylinder, there can be a delay from actuation of a joystick to movement of a respective portion of the implement. Such delays can result in undesired movements of the implement which can result in bucket 106 digging below a desired grade. For example, a user may operate a joystick to move stick 104 toward the body of excavator 100. As stick 104 begins to move, the user actuates a joystick to move boom 102 upward in order to prevent bucket 106 from digging below a desired grade. A delay between actuation of the joystick to move boom 102 upward as stick 104 is moving toward the body of excavator 100 can cause bucket 106 to dig below a desired grade before boom 104 begins moving upward in response to actuation of a respective joystick.

Figure 3:
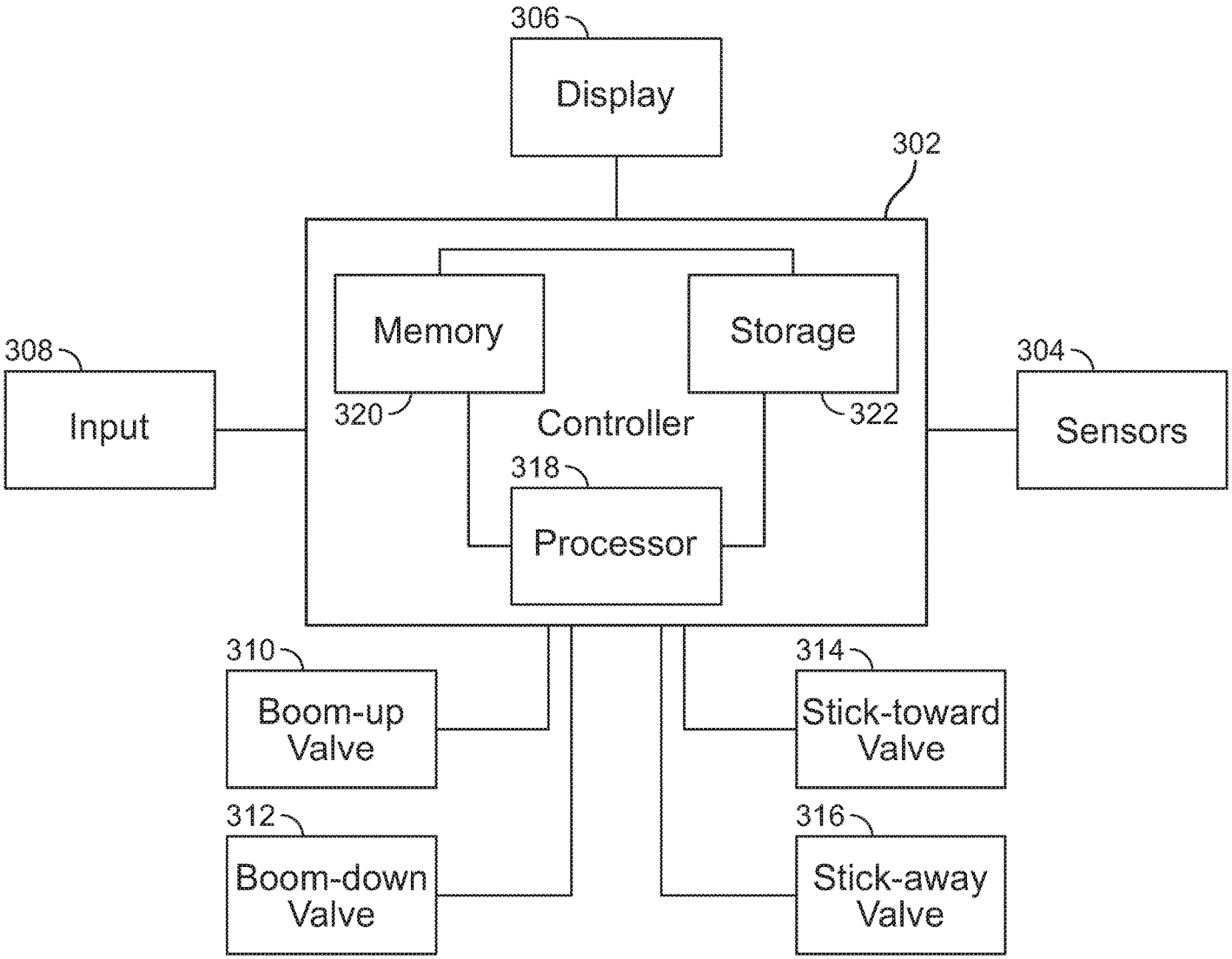
FIG. 3 shows a controller and related components for sensing, limiting and delaying user inputs to an excavator.

FIG. 3 depicts a schematic of components of excavator 100 related to automatic control of boom 102 and stick 104 according to an embodiment. Controller 302, in one embodiment, is implemented using a computer. Controller 302 contains a processor 318 which controls the overall operation of the controller 302 by executing computer program instructions which define such operation. The computer program instructions may be stored in a storage device 322, or other computer readable medium (e.g., magnetic disk, CD ROM, etc.), and loaded into memory 320 when execution of the computer program instructions is desired. Thus, the method steps of FIG. 7 (described below) can be defined by the computer program instructions stored in the memory 320 and/or storage 322 and controlled by the processor 318 executing the computer program instructions. For example, the computer program instructions can be implemented as computer executable code programmed by one skilled in the art to perform an algorithm defined by the method steps of FIG. 7. Accordingly, by executing the computer program instructions, the processor 318 executes an algorithm defined by the method steps of FIG. 7. One skilled in the art will recognize that an implementation of a controller could contain other components as well, and that controller 302 is a high level representation of some of the components of such a controller for illustrative purposes.

Sensors 304 include one or more sensors for detecting a location and state of excavator 100. In one embodiment, the location of excavator 100 is determined using a GPS receiver and/or an inertial measurement unit (IMU). In one embodiment, the state of excavator 100 is determined using linear or rotary sensors and/or inertial measurement units for determining the position boom 102, stick 104, and bucket 106 of the implement. Sensors 304, in one embodiment, can also include sensors for detecting a current state of a construction site. For example, sensors 304 can include a camera, infrared scanner, or other types of devices for determining a current state of a construction site in which excavator 100 is located.

Input 308, in one embodiment, includes inputs from a user operating excavator 100. In one embodiment, input 308 can include one or more joysticks for moving boom 102, stick 104, and bucket 106. For example, a boom joystick can be actuated by the user to command boom 102 to raise or lower. Similarly, a stick joystick (i.e., a joystick for controlling movement of stick 104) can be actuated by the user to command stick 104 toward body of excavator 100 or away from body of excavator 100. In one embodiment, inputs associated with joysticks are signals from sensors associated with each respective joystick. Inputs from joystick actuation can also be received from sensors detecting changes in hydraulic pressure associated with movement of a respective joystick. Input 308 can also include inputs from a user via input devices such as touch screens, buttons, and other types of inputs.

Display 306, in one embodiment, is located in the cab of excavator 100 and displays information to a user. Display 306 can be any type of display such as a touch screen, a light emitting diode display, a liquid crystal display, heads-up projected display, etc. Display 306 presents various information to a user concerning a related machine, a current site plan, a desired site plan, etc.

Controller 302 is connected to multiple control valves associated with an implement of excavator 100. Boom-up valve 310 and boom-down valve 312, in one embodiment, are electro mechanical valves that are used to control movement of boom 102 of excavator 100 by directing hydraulic fluid pressure to a hydraulic cylinder associated with boom 102. Stick-toward valve 314 and stick-away valve 316, in one embodiment, are electro mechanical valves that are used to control movement of stick 104 of excavator 100 by directing hydraulic fluid pressure to a hydraulic cylinder associated with stick 104. Controller 302 can also be connected to electro mechanical valves for controlling bucket 106 or other machinery associated with excavator 100.

In one embodiment, controller 302 receives input from input 308 and sensors 304. Controller 302 analyzes that input and determines information for display to a user via display 306. Controller 302 also analyzes the input and determines if outputs should be sent to boom-up valve 310 or boom-down valve 312 to control boom 102 and/or stick-toward valve 314 or stick-away valve 316 to control stick 104. In one embodiment, controller 302 can also delay movement of boom 102 and/or stick 104 that would otherwise occur based on input from a user via input 308 during normal operation by actuating one or more of valves 310, 312, 314, 316.

Figure 4:
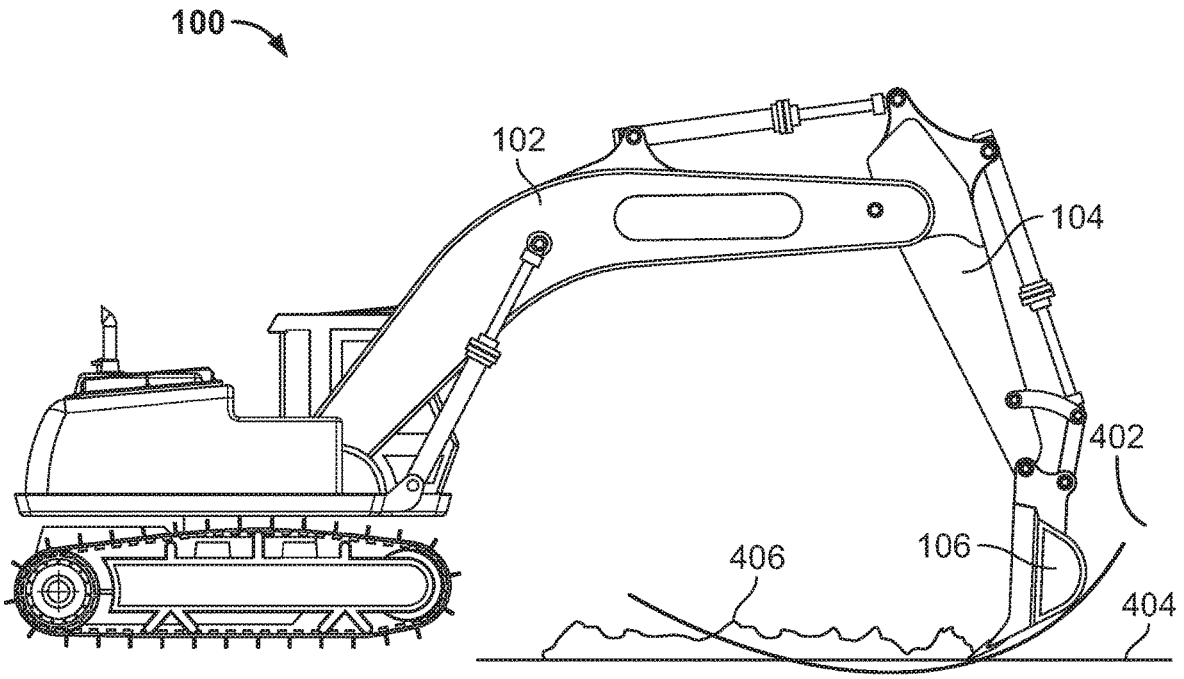
FIG. 4 shows an excavator modifying a construction site in which the bucket will go below a desired grade.

Excavator 100 shown in FIG. 4 is depicted in the process of modifying surface 406 to remove material located above desired grade 404. In one embodiment, controller 302 delays movement of stick 104 of excavator 100 in response to input from a user commanding stick 104 to move via input 308 (e.g., input from a joystick). FIG. 4 shows that bucket 106 will sweep an arc 402 that will cause the bucket to go below a desired grade 404, if it is allowed to move solely in response to input from a user. Controller 302 determines that allowing bucket 106 to move along arc 402 will cause bucket 106 to go below desired grade 404. In one embodiment, controller 302 determines that bucket 106 will go below the desired grade based on a comparison of how movement of bucket 106 (caused by movement of stick 104) will modify the current site compared to a desired site plan.

In response to determining that bucket 106 will go below desired grade 404, controller 302 overrides user input to prevent bucket from digging below desired grade 404. In one embodiment, controller 302 delays movement of stick 104 and then controls movement of stick 104 synchronized with raising boom 102 in order to move bucket 106 without having bucket 106 dig below desired grade 404. Controller 302 causes boom 102 to move upward a specific distance at which bucket 106 will not go below desired grade 404 as stick 104 moves through its arc. Controller 302 transmits signals, as necessary, to boom-up valve 310, boom-down valve 312, stick-toward valve 314 and/or stick-away valve 316 which are part of a hydraulic system for actuating boom 102 and stick 104. It should be noted that delay of user input and synchronization of boom and stick movement can occur when operating excavator 100 semi-automatically of when full automatic control is being used without an operator present.

Figure 5:
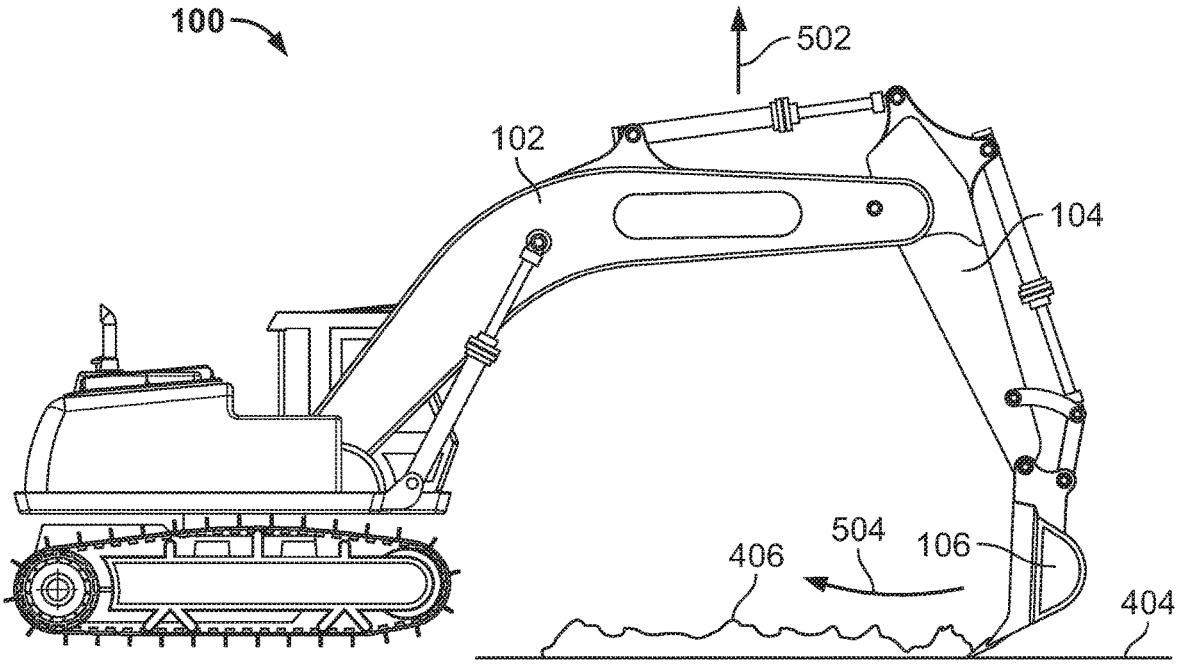
FIG. 5 shows an excavator modifying a construction site in which the bucket will maintain its position at or above the desired grade.

FIG. 5 depicts movement of bucket 106 along desired grade 404. User input to move stick 104 would have caused bucket 106 to go below desired grade as shown in FIG. 4. Movement of stick 104 toward body of excavator, as shown by arrow 504, was delayed by controller 302 and synchronized with upward movement of boom 102, as shown by arrow 502, to prevent bucket 106 from digging below desired grade 404. As shown in FIG. 5, bucket 106 will remove material from surface 406 without digging below desired grade 404 due to delayed movement of stick and then synchronized movement of stick toward body of excavator 100 and upward movement of boom 102.

Figure 6A:
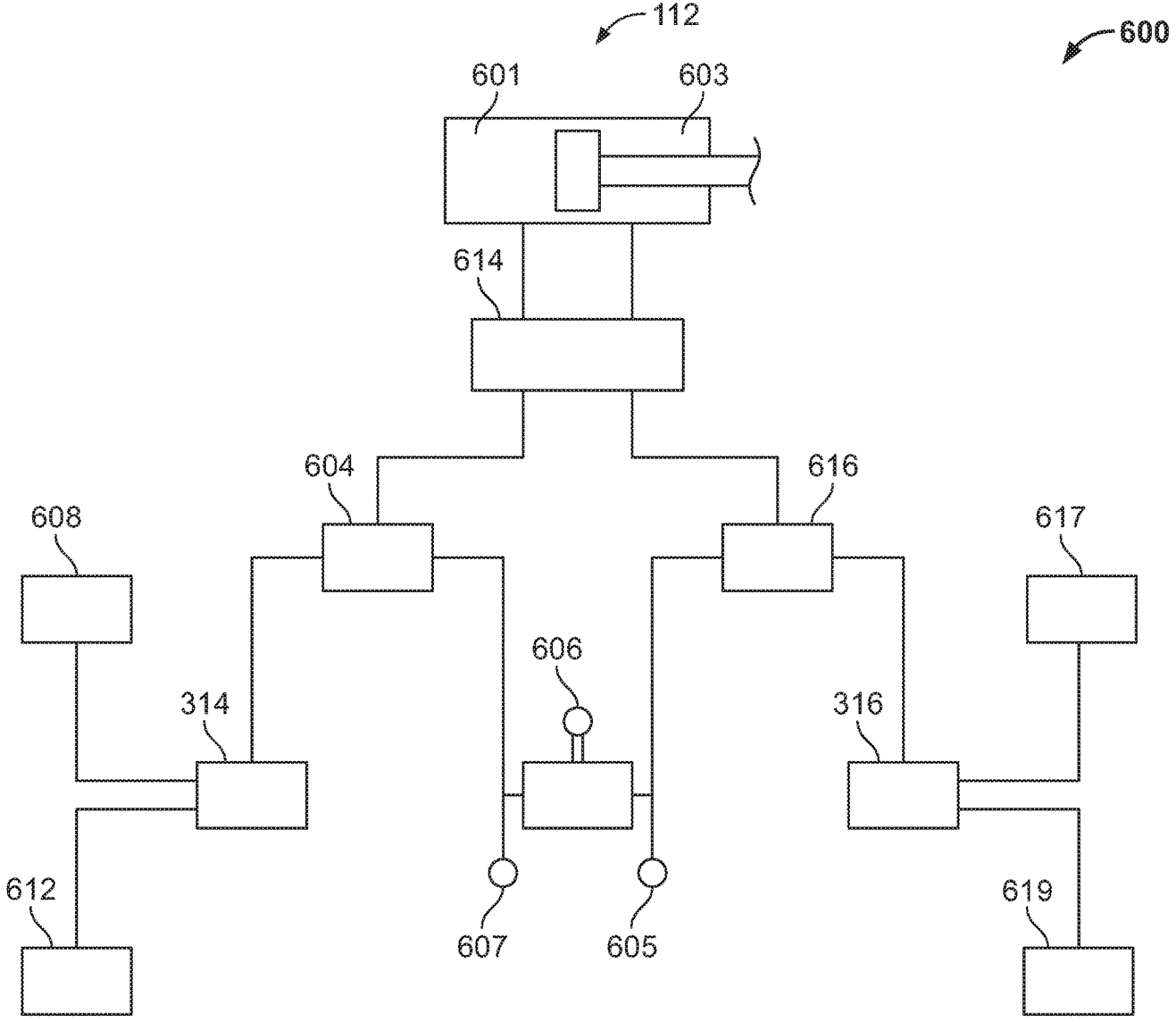
FIG. 6A shows a portion of a hydraulic system of an excavator associated with movement of a stick of the excavator.

FIG. 6A shows a schematic representing a portion of a hydraulic system 600 of excavator 100. A user manipulates joystick 606 to command stick 104 of excavator 100 to move toward the body of excavator 100 or away from the body of excavator 100. It should be noted that joystick 606 (as well as other joysticks described herein), in one embodiment, can be supplied with a pilot hydraulic fluid pressure that is diverted in response to actuation of joystick 606 to be applied to a hydraulic component.

Joystick 606 can be manipulated to cause hydraulic fluid pressure to be applied to stick toward cavity 601 of hydraulic cylinder 112 through shuttle valve 604 and main valve 614. Main valve 614 (as well as other main valves described herein), in one embodiment, are mechanical hydraulic valves having two inputs and two outputs. Hydraulic fluid pressure is applied to one of the two outputs of the main valve based on hydraulic fluid pressure applied to its inputs. Hydraulic cylinder 112 is connected to stick 104 (as shown in FIG. 1) and movement of the piston of hydraulic cylinder 112 causes movement of stick 104. Shuttle valve 604 is a hydraulic device that applies hydraulic fluid pressure to an output connected to main valve 614 based on a pressure differential across two inputs. One input of shuttle valve 604 is connected to joystick 606 and the other input is connected to stick toward valve 314. Hydraulic fluid pressure applied by joystick 606 to shuttle valve 604 is sensed by hydraulic fluid pressure sensor 607. Stick toward valve 314 is an electromechanical device controlled by signals from controller 302 to apply hydraulic fluid pressure to shuttle valve 604. Hydraulic fluid pressure is supplied to stick toward valve 314 from pilot supply 608 and hydraulic fluid not diverted by stick toward valve 314 is returned to fluid tank 612 which provides the hydraulic fluid for pilot supply 608.

Joystick 606 can also be manipulated to cause hydraulic fluid pressure to be applied to stick away cavity 603 of hydraulic cylinder 112 through shuttle valve 616 and main valve 614. Hydraulic cylinder 112 is connected to stick 104 (as shown in FIG. 1) and movement of the piston of hydraulic cylinder 112 causes movement of stick 104. Shuttle valve 616 is a hydraulic device that applies hydraulic fluid pressure to an output connected to main valve 614 based on a pressure differential across two inputs. One input of shuttle valve 616 is connected to joystick 606 and the other input is connected to stick away valve 316. Hydraulic fluid pressure applied by joystick 606 to shuttle valve 616 is sensed by hydraulic fluid pressure sensor 605. Stick away valve 316 is an electromechanical device controlled by signals from controller 302 to apply hydraulic fluid pressure to shuttle valve 616. Hydraulic fluid pressure is supplied to stick away valve 316 from pilot supply 617 and hydraulic fluid not diverted by stick toward valve 316 is returned to fluid tank 619 which provides the hydraulic fluid for pilot supply 617.

A user moving joystick 606 in a first direction (e.g., to the right of joystick 606 shown in FIG. 6A) is commanding stick 104 to move away from the body of excavator 100. When joystick 606 is moved in the first direction, hydraulic fluid pressure is applied to stick away cavity 603 of hydraulic cylinder 112 which causes stick 104 of excavator 100 to move away from the body of excavator 100.

A user moving joystick 606 in a second direction (e.g. to the left of joystick 606 shown in FIG. 6A) is commanding stick 104 to move toward the body of excavator 100. When joystick 606 is moved in the second direction, hydraulic fluid pressure is applied to stick toward cavity 601 of hydraulic cylinder 112 which causes stick 104 of excavator 100 to move toward the body of excavator 100. The hydraulic fluid pressure applied to hydraulic cylinder 112 is in response to movement of joystick 606. In one embodiment, movement of stick 104 toward the body of excavator 100 can be delayed and/or prevented by applying hydraulic fluid pressure from stick toward valve 314 to shuttle valve 604 to counteract hydraulic fluid pressure applied to shuttle valve 604 by joystick 606. This is referred to as hydraulically delaying movement of stick 104.

Figure 6B:
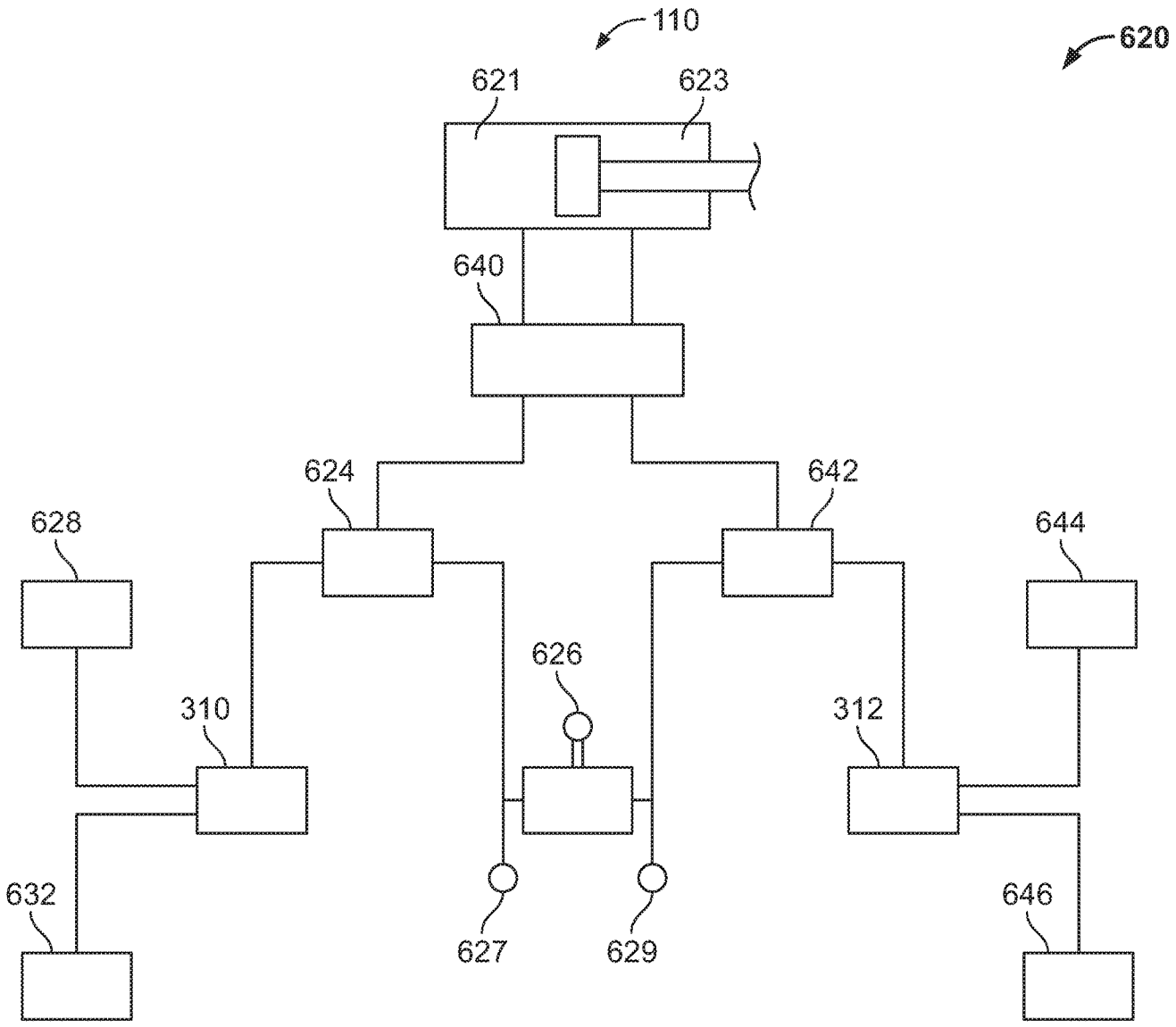
FIG. 6B shows a portion of a hydraulic system of an excavator associated with movement of a boom of the excavator.

FIG. 6B shows a schematic representing a portion of a hydraulic system 620 of excavator 100. A user manipulates joystick 626 to command boom 102 of excavator 100 to move up or down relative to the surface on which the excavator is located.

Joystick 626 can be manipulated to cause hydraulic fluid pressure to be applied to boom up cavity 621 of hydraulic cylinder 110 through shuttle valve 624 and main valve 640. Hydraulic cylinder 110 is connected to boom 102 (as shown in FIG. 1) and movement of the piston of hydraulic cylinder 110 causes movement of boom 102. Shuttle valve 624 is a hydraulic device that applies hydraulic fluid pressure to an output connected to main valve 640 based on a pressure differential across two inputs. One input of shuttle valve 624 is connected to joystick 626 and the other input is connected to boom up valve 310. Hydraulic fluid pressure applied by joystick 626 to shuttle valve 624 is sensed by hydraulic fluid pressure sensor 627. Boom up valve 310 is an electromechanical device controlled by signals from controller 302 to apply hydraulic fluid pressure to shuttle valve 624. Hydraulic fluid pressure is supplied to boom up valve 310 from pilot supply 628 and hydraulic fluid not diverted by boom up valve 624 is returned to fluid tank 632 which provides the hydraulic fluid for pilot supply 628.

Joystick 626 can be manipulated to cause hydraulic fluid pressure to be applied to boom down cavity 623 of hydraulic cylinder 110 through shuttle valve 642 and main valve 640. Hydraulic cylinder 110 is connected to boom 102 (as shown in FIG. 1) and movement of the piston of hydraulic cylinder 110 causes movement of boom 102. Shuttle valve 642 is a hydraulic device that applies hydraulic fluid pressure to an output connected to main valve 640 based on a pressure differential across two inputs. One input of shuttle valve 642 is connected to joystick 626 and the other input is connected to boom down valve 312. Hydraulic fluid pressure applied by joystick 626 to shuttle valve 642 is sensed by hydraulic fluid pressure sensor 629. Boom down valve 312 is an electromechanical device controlled by signals from controller 302 to apply hydraulic fluid pressure to shuttle valve 642. Hydraulic fluid pressure is supplied to boom down valve 312 from pilot supply 644 and hydraulic fluid not diverted by boom down valve 312 is returned to fluid tank 646 which provides the hydraulic fluid for pilot supply 644.

A user moving joystick 626 in first direction (e.g., to the right of joystick 626 shown in FIG. 6B) is commanding boom 102 to move down. When joystick 626 is moved in the first direction, hydraulic fluid pressure is applied to one side of hydraulic cylinder 110 which causes boom 102 of excavator 100 to move down.

A user moving joystick 626 in a second direction (e.g. to the left of joystick 626 shown in FIG. 6B) is commanding boom 102 to move up. When joystick 626 is moved in the second direction, hydraulic fluid pressure is applied to boom up cavity 621 of hydraulic cylinder 110 which causes boom 102 to move upward. The hydraulic fluid pressure applied to boom up cavity 621 of hydraulic cylinder 110 is in response to movement of joystick 626. In one embodiment, boom 102 can be moved upward by controller 302 transmitting signals to boom up valve 310 to apply hydraulic fluid pressure to shuttle valve 624 to overcome hydraulic fluid pressure applied to shuttle valve 624 by boom joystick 626. The pressure differential across the inputs of shuttle valve 624 causes shuttle valve 624 to apply hydraulic fluid pressure to boom up cavity 621 of hydraulic cylinder 110 to cause boom 102 to move upward. Also, movement of boom 102 upward can be prevented by applying hydraulic fluid pressure to shuttle valve 624 to counteract hydraulic fluid pressure applied to shuttle valve 624 by joystick 626.

When excavator 100 is operated manually using only user inputs (e.g. from joysticks 606, 626), boom 102 can be moved up or down using joystick 626. Similarly, stick 104 can be moved toward the body of excavator 100 or away from the body of excavator 100 using joystick 606. In one embodiment, excavator can be operated in a mode to prevent digging below a desired grade. This mode can be referred to as the grade assist mode. When excavator 100 is operated in grade assist mode, controller 302 assists a user in modifying a surface to a desired grade by synchronizing movement of stick 104 and boom 102.

Figure 7:
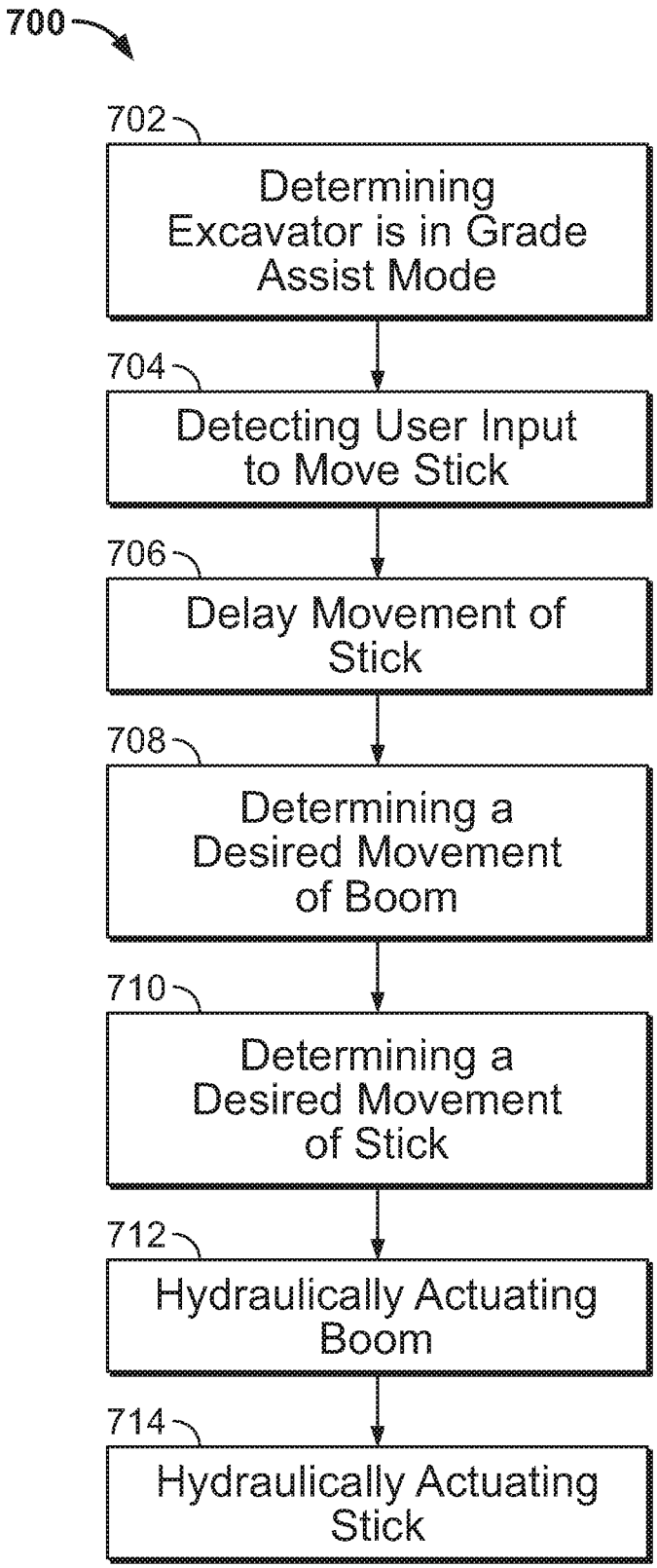
FIG. 7 shows a flow chart of a method for delaying user inputs to an excavator according to an embodiment.

FIG. 7 shows a flow chart of a method 700 according to one embodiment for assisting a user in modifying a surface to a desired grade using excavator 100. At step 702, controller 302 determines that excavator 100 is in grade assist mode. In one embodiment, a user can enter grade assist mode using input 308 (e.g. a button or a virtual button on display 306). When controller 302 is in grade assist mode, it monitors user inputs to prevent bucket 106 from modifying a surface below a desired grade. At step 704, controller 302 detects user input to move stick 104 toward the body of excavator 100. In one embodiment, controller 302 detects a signal to move stick 104 toward body of excavator 100. In one embodiment, the signal is generated by hydraulic fluid pressure sensor 607 in response to hydraulic pressure applied to joystick side of shuttle 604 from joystick 606. User input can also be detected using a sensor, e.g., a pressure sensor, a pressure switch, an inertial movement sensor, an electrical input if the system is electrically piloted, etc. associated with joystick 606 that produces a signal.

Returning to FIG. 7, at step 706, controller 302 delays and/or prevents movement of stick 104 by applying hydraulic fluid pressure to shuttle 604. The hydraulic fluid pressure is applied to shuttle 604 by stick toward valve 314 is in response to a signal from controller 302. The hydraulic fluid pressure applied to shuttle 604 by stick toward valve opposes the hydraulic fluid pressure applied to shuttle 604 by joystick 606. In one embodiment, the pressures are substantially equal to prevent movement of shuttle 604 thereby stopping and/or preventing movement of stick 104. The exact pressures required to prevent movement of shuttle 604 may vary depending on various factors such as resistance to hydraulic flow in conduits carrying the hydraulic fluid.

At step 708 a desired movement of boom 102 is determined. In one embodiment, the desired movement of the boom is determined in response to the signal and is based on predicted movement of stick 104 in response to the signal. For example, a signal received by controller 302 can have a certain magnitude. That magnitude can be associated with a user pilot pressure from sensor 607. As such, the signal can be used to determine a predicted movement of stick 104. The corresponding desired movement of the boom maintains a bucket of the construction machine above a desired grade. Maintaining the bucket above the desired grade prevents digging below the desired grade.

At step 710, a desired movement of the stick of the construction machine is determined in response to the signal and is based on the predicted movement of the stick and the user input as sensed by 607, and the desired movement of the boom to maintain the bucket of the construction machine above the desired grade. In one embodiment, the desired movement of the stick is further based on the determined desired movement of the boom. For example, the predicted movement of the stick can be used to determine a swing arc bucket 106 will traverse based on a height of boom 102. The desired movement of the stick can be used to determine how much boom 103 needs to be raised as stick 104 traverses its arc to maintain bucket 106 of construction machine 100 above the desired grade.

Determining the desired movement of the boom and the stick, in one embodiment, is further based on a current position of the bucket of the construction machine with respect to the desired grade. Since stick 104 will move through an arc, bucket 106 will also move through an arc. Both the arc of stick 104 and bucket 106 are dependent on a height of boom 102 because stick 104 swings about a pivot located on boom 102. The current position of the bucket, in one embodiment, is based on data from sensors for detecting positions of the boom, the stick, and the bucket.

At step 712, boom 102 and stick 104 are hydraulically actuated based on the desired movement of the boom and the stick. In one embodiment, boom 102 is hydraulically actuated in response to a signal from controller 302 to boom up valve 310 which causes hydraulic fluid pressure to be applied to shuttle valve 624 which then applies hydraulic fluid pressure to hydraulic cylinder 110. The signal transmitted to boom up valve 310, in one embodiment, is calculated to move boom 102 upward at a rate to prevent bucket 106 from digging below a desired grade as stick 104 swings through an arc. In one embodiment, stick 104 is hydraulically actuated in response to a signal from controller 302 to stick toward valve 314 which causes hydraulic fluid pressure to be applied to shuttle valve 604 which then applies hydraulic fluid pressure to hydraulic cylinder 112. The signal transmitted to stick toward valve 314, in one embodiment, is calculated to move stick 104 through its swing arc as boom 102 moves upward at a rate to prevent bucket 106 from digging below a desired grade.

In one embodiment, the movement of the stick and the boom are synchronized to move simultaneously in order to modify a surface without digging below a desired grade. The synchronized and/or simultaneous movement of the boom and the stick prevents the bucket from dipping below the desired grade prior to movement of the boom. Such dipping often occurs because of a delay between the time the stick is moved, if solely from unpredictable user input, and the time the boom is moved via controller 302.

It should be noted that both movement of the boom and movement of the stick affect the position and movement of the bucket. As such, in one embodiment, determining a desired movement of the boom is based on a swing arc of the stick and a swing arc of the boom. Similarly, in one embodiment, determining a movement of the stick is based on a swing arc of the stick and a swing arc of the boom. It should be noted that stick movement and/or limits and boom movement and/or limits can be determined by controller 302 based on both user input and a desired surface design.

In the embodiments described above, user input commanding boom 102 or stick 104 to move are delayed by applying an opposing hydraulic fluid pressure to a respective shuttle valve. User inputs commanding boom 102 and stick 104 to move can be delayed and/or blocked using other methods as well. In one embodiment, an inverse proportional valve is used to block hydraulic fluid pressure applied to a respective shuttle valve in response to user input. In one embodiment, a 3 way, 2 position solenoid valve is used as a shuttle valve connected to a respective main valve to control hydraulic fluid pressure applied to the respective hydraulic cylinder. The delay in actuation and/or blocking, in one embodiment, is achieved by detecting hydraulic fluid pressure applied in response to user input and delaying and duplicating the response to the user input by reducing, limiting, or zeroing user inputs by the controller 302 based on a computed trajectory of the implement of the excavator relative to a desired design surface trajectory (e.g., a desired design surface shape).

Figure 8:
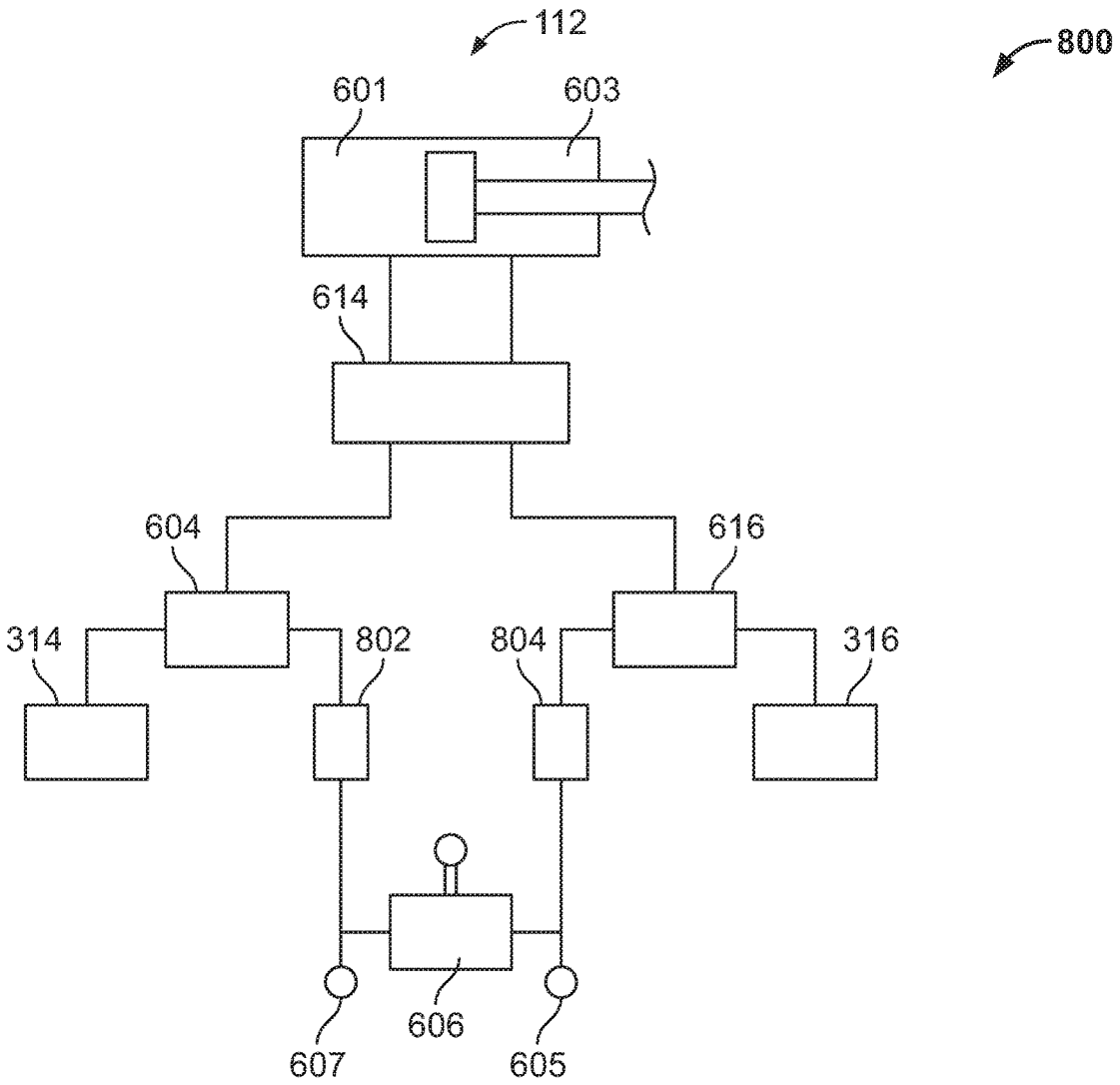
FIG. 8 depicts a portion of a hydraulic circuit using an inverse proportional valve according to an embodiment.

FIG. 8 depicts an embodiment of a hydraulic circuit 800 using inverse proportional valves to block hydraulic fluid pressure applied in response to user input. An inverse proportional valve is an electro-mechanical valve for controlling the application of hydraulic pressure from its input to its output. Hydraulic cylinder 112 is connected to and associated with stick 104 of excavator 100. Hydraulic cylinder 112 is actuated in response to hydraulic fluid pressure applied to one of its two inputs from a corresponding one of two outputs of main valve 614. Main valve 614 is actuated in response to hydraulic fluid pressure applied from shuttle valve 604 and/or shuttle valve 616.

Shuttle valve 604 has one input for receiving hydraulic fluid pressure from stick toward valve 314 and another input for receiving hydraulic fluid pressure from joystick 606 through inverse proportional valve 802. Hydraulic fluid pressure applied to shuttle valve 604 in response to actuation of joystick 606 is sensed by hydraulic fluid pressure sensor 607. Shuttle valve 616 has one input for receiving hydraulic fluid pressure from stick away valve 316 and another input for receiving hydraulic fluid pressure from joystick 606 through inverse proportional valve 804. Hydraulic fluid pressure applied to shuttle valve 616 in response to actuation of joystick 606 is sensed by hydraulic fluid pressure sensor 605.

Hydraulic fluid pressure applied to shuttle valve 604 in response to actuation of joystick 606 can be blocked by inverse proportion valve 802. Hydraulic fluid pressure applied to shuttle valve 604 is detected by hydraulic fluid sensor 607 which is in communication with controller 302. Controller 302 determines when user input is required to be delayed and/or blocked as described by the method shown in FIG. 7 and described above. When user input causing hydraulic fluid pressure to be applied to shuttle valve 604 in response to actuation of joystick 606 is to be delayed or blocked, controller 302 transmits a signal to inverse proportional valve 802. Inverse proportional valve 802 blocks the hydraulic fluid pressure applied from joystick 606 from being applied to shuttle valve 604. As such, controller 302 blocks the application of hydraulic fluid pressure to shuttle valve 604 in response to user input via actuation of joystick 606.

Controller 302 can actuate stick toward valve 316 to apply hydraulic fluid pressure to shuttle valve 604 a period of time after manipulation of joystick 606 by a user. Thus, user input can be blocked or delayed in order to synchronize movement of stick 104 and boom 102 by the controller 302 based on a computed trajectory of the implement of the excavator relative to a desired design surface trajectory (e.g., a desired design surface shape). Inverse proportion valve 804, hydraulic fluid pressure sensor 605, shuttle valve 616, and stick away valve 316 can be used in conjunction with controller 302 to similarly block and/or delay hydraulic fluid pressure applied to shuttle valve 616 in response to hydraulic fluid pressure applied shuttle valve 616 in response to actuation of joystick 606.

Figure 9:
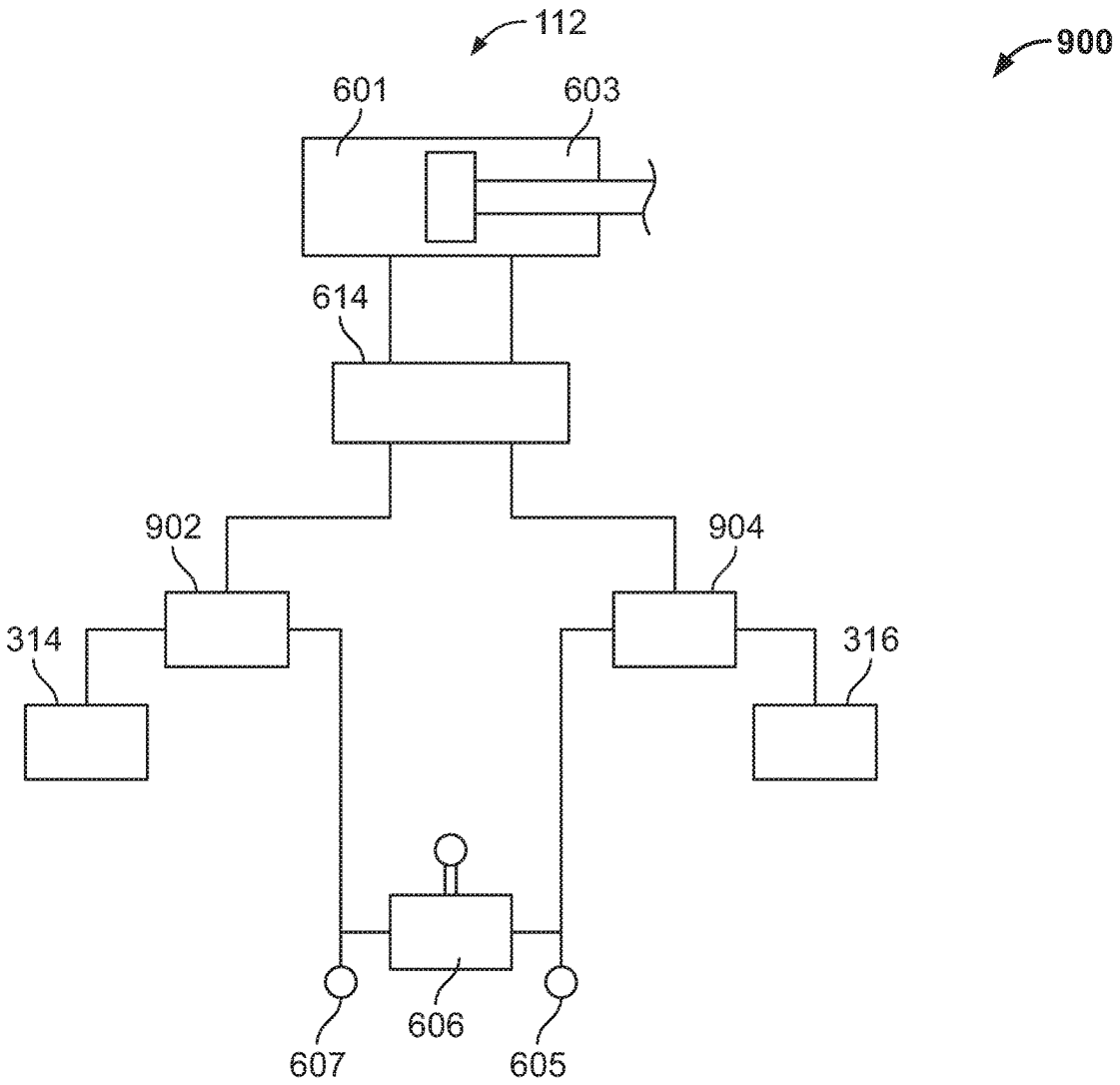
FIG. 9 depicts a portion of a hydraulic circuit using a 3 way, 2 position solenoid valve according to an embodiment.

FIG. 9 depicts an embodiment of hydraulic circuit 900 using a 3 way, 2 position solenoid valves 902, 904 in place of shuttle valves (such as shuttle valves 604 and 616 shown in FIG. 6A). The 3 way, 2 position solenoid valve (referred to as a "solenoid valve") is an electronic mechanical valve for controlling the application of hydraulic fluid pressure from each of its two inputs to its one output. In a first position, the solenoid valve directs hydraulic fluid pressure from its first input to its output. In the first position, hydraulic fluid pressure applied to the second input of the solenoid valve is blocked (i.e., prevented from being applied to the output of the solenoid valve). In the second position, the solenoid valve directs hydraulic fluid pressure from its second input to its output. In the second position, hydraulic fluid pressure applied to the first input of the solenoid valve is blocked (i.e., prevented from being applied to the output of the solenoid valve. The position of solenoid valves 902 and 904 are controller by signals from controller 302.

Solenoid valve 902 has the output of stick toward valve 314 connected to one of its inputs and an output of joystick 606 connected to its other input. Hydraulic fluid pressure applied from one of joystick 606 or stick toward valve 314 is blocked from being output from solenoid valve 902 based on the position of solenoid valve 902 as commanded by a signal from controller 302 transmitted to solenoid 902. Solenoid valve 904 has stick away valve 316 connected to one of its inputs and an output of joystick 606 connected to its other input. Hydraulic fluid pressure applied from one of joystick 606 or stick away valve 316 is blocked from being output from solenoid valve 904 based on the position of solenoid valve 904 as commanded by a signal from controller 302 transmitted to solenoid 904.

Hydraulic fluid pressure applied to solenoid valve 902 in response to actuation of joystick 606 is sensed by hydraulic fluid pressure sensor 607 which is in communication with controller 302. Hydraulic fluid pressure applied to solenoid valve 902 in response to actuation of joystick 606 can be blocked by solenoid valve 902 in response to a signal from controller 302. Controller 302 determines when user input is required to be delayed and/or blocked as described by the method shown in FIG. 7 and described above. When user input causing hydraulic fluid pressure to be applied to solenoid valve 902 in response to actuation of joystick 606 is to be delayed or blocked, controller 302 transmits a signal to solenoid valve 902. Solenoid valve 902 blocks the hydraulic fluid pressure applied from joystick 606 from being applied to main valve 614. As such, controller 302 blocks the application of hydraulic fluid pressure to main valve 614 in response to user input via actuation of joystick 606. Controller 302 can actuate stick toward valve 314 to apply hydraulic fluid pressure to main valve 614 through solenoid valve 902 a period of time after manipulation of joystick 606 by a user. Thus, user input can be blocked or delayed in order to synchronize movement of stick 104 and boom 102 by the controller 302 based on a computed trajectory of the implement of the excavator relative to a desired design surface trajectory (e.g., a desired design surface shape).

It should be noted that hydraulic circuit 800 and hydraulic circuit 900 can include additional components to block and/or delay movement of additional hydraulically actuated components and/or members such as bucket 106 as well as other hydraulically actuated components and/or members.

It should be noted that the system of computer control, delay, attenuation and/or override of user inputs can be used for any hydraulic implement or parts of a hydraulic implement. For example, the system of computer control, delay, attenuation and/or and override of user inputs can be used with stick 104 and bucket 106 of excavator 100.

The foregoing Detailed Description is to be understood as being in every respect illustrative and exemplary, but not restrictive, and the scope of the inventive concept disclosed herein is not to be determined from the Detailed Description, but rather from the claims as interpreted according to the full breadth permitted by the patent laws. It is to be understood that the embodiments shown and described herein are only illustrative of the principles of the inventive concept and that various modifications may be implemented by those skilled in the art without departing from the scope and spirit of the inventive concept. Those skilled in the art could implement various other feature combinations without departing from the scope and spirit of the inventive concept.

The invention claimed is:

1. A method comprising:

detecting a signal to move a stick of a construction machine about a pivot point of the stick;

hydraulically preventing movement of the stick about the pivot point of the stick until synchronized movement of a boom of the construction machine;

determining a desired movement of the boom of the construction machine in response to the signal and based on predicted movement of the stick in response to the signal, the desired movement of the boom to maintain a bucket of the construction machine above a desired grade;

determining a desired movement of the stick of the construction machine in response to the signal and based on the predicted movement of the stick in response to the signal and the desired movement of the boom, the desired movement of the stick to maintain the bucket of the construction machine above the desired grade;

hydraulically actuating the boom based on the desired movement of the boom; and hydraulically actuating the stick based on the desired movement of the stick.

2. The method of claim 1, wherein the determining the desired movement of the boom and the determining the desired movement of the stick are further based on a current position of the bucket of the construction machine with respect to the desired grade.

3. The method of claim 2, wherein the current position of the bucket is based on data from sensors for detecting positions of the boom, the stick, and the bucket.

4. The method of claim 3, wherein the determining a desired movement of the stick is further based on the determining a desired movement of the boom.

5. The method of claim 1, further comprising:

determining that the construction machine is in a grade assist mode.

6. The method of claim 1, wherein the determining a desired movement of the boom is based on a swing arc of the stick and a swing arc of the boom.

7. The method of claim 1, wherein the hydraulically actuating the boom is simultaneous with the hydraulically actuating the stick.

8. The method of claim 1, wherein the hydraulically preventing, for a period of time, movement of the stick comprises actuating an inverse proportional valve blocking hydraulic fluid pressure applied in response to user input from causing movement of the stick.

9. The method of claim 1, wherein the hydraulically preventing, for a period of time, movement of the stick comprises actuating a solenoid valve blocking hydraulic fluid pressure applied to a first input of the solenoid valve in response to user input from causing movement of the stick.

10. The method of claim 9, wherein the stick is actuated by application of hydraulic fluid pressure from a controller actuated valve to a second input of the solenoid valve.

11. An apparatus comprising:

a processor; and a memory to store computer program instructions, the computer program instructions when executed by the processor cause the processor to perform operations comprising:

detecting a signal to move a stick of a construction machine about a pivot point of the stick;

hydraulically preventing user movement of the stick about the pivot point of the stick until synchronized movement of a boom of the construction machine;

determining a desired movement of the boom of the construction machine in response to the signal and based on predicted movement of the stick in response to the user signal, the desired movement of the boom to maintain a bucket of the construction machine above a desired grade;

determining a desired movement of the stick of the construction machine in response to the signal and based on the predicted movement of the stick in response to the signal and the desired movement of the boom, the desired movement of the stick to maintain the bucket of the construction machine above the desired grade;

hydraulically actuating the boom based on the desired movement of the boom; and hydraulically actuating the stick based on the desired movement of the stick.

12. The apparatus of claim 11, wherein the determining the desired movement of the boom and the determining the desired movement of the stick are further based on a current position of the bucket of the construction machine with respect to the desired grade.

13. The apparatus of claim 12, wherein the current position of the bucket is based on data from sensors for detecting positions of the boom, the stick, and the bucket.

14. The apparatus of claim 13, wherein the determining a desired movement of the stick is further based on the determining a desired movement of the boom.

15. The apparatus of claim 11, the operations further comprising:

determining that the construction machine is in a grade assist mode.

16. The apparatus of claim 11, wherein the determining a desired movement of the boom is based on a swing arc of the stick and a swing arc of the boom.

17. The apparatus of claim 11, wherein the hydraulically actuating the boom is simultaneous with the hydraulically actuating the stick.

18. The apparatus of claim 11, wherein the hydraulically preventing, for a period of time, movement of the stick comprises actuating an inverse proportional valve blocking hydraulic fluid pressure applied in response to user input from causing movement of the stick.

19. The apparatus of claim 11, wherein the hydraulically preventing, for a period of time, movement of the stick comprises actuating a solenoid valve blocking hydraulic fluid pressure applied to a first input of the solenoid valve in response to user input from causing movement of the stick.

20. The apparatus of claim 19, wherein the stick is actuated by application of hydraulic fluid pressure from a controller actuated valve to a second input of the solenoid valve.

* * * * *